US006402346B1

(12) United States Patent
Liao et al.

(10) Patent No.: US 6,402,346 B1
(45) Date of Patent: Jun. 11, 2002

(54) EASY-HEAT-DISSIPATION SPOTLIGHT STRUCTURE

(75) Inventors: Juicy Liao; Rick Lin, both of Hsinchu (TW)

(73) Assignee: Compaq Computer Corporation, Houston, TX (US)

( * ) Notice: Subject to any disclaimer, the term of this patent is extended or adjusted under 35 U.S.C. 154(b) by 0 days.

(21) Appl. No.: 09/412,784

(22) Filed: Oct. 5, 1999

(30) Foreign Application Priority Data

Jun. 10, 1999 (TW) ..... 88209695 U

(51) Int. Cl.[7] ..... F21V 29/00

(52) U.S. Cl. ..... 362/294; 362/373; 362/188; 362/288; 362/264

(58) Field of Search ..... 362/188, 288

(56) References Cited

U.S. PATENT DOCUMENTS 5,515,251 A * 5/1996 Abke ..... 362/127
5,758,957 A * 6/1998 Perrotin ..... 362/294
5,860,719 A * 1/1999 Suzuki et al. ..... 362/294
6,068,385 A * 5/2000 Hsieh ..... 362/188
6,164,806 A * 12/2000 Shmickl et al. ..... 362/547

* cited by examiner

*Primary Examiner*—Sandra O'Shea
*Assistant Examiner*—Anabel Ton
(74) *Attorney, Agent, or Firm*—Bacon & Thomas, PLLC

(57) ABSTRACT

The present invention provides an easy-heat-dissipation spotlight structure comprising a reflector formed with an inner semi-ellipsoidal reflecting surface and having an open end; a light-emitting lamp body provided at the central location of the reflector; a lamp cover provided at the open end and formed with an inlet at its lower end; and an air guider installed at the inlet of the lamp cover so that an airflow can be directed into the space defined by the lamp cover and the reflector.

2 Claims, 5 Drawing Sheets

EASY-HEAT-DISSIPATION SPOTLIGHT STRUCTURE

FIELD OF THE INVENTION

The present invention relates to a spotlight structure and, more particularly, to an easy-heat-dissipation spotlight structure.

BACKGROUND OF THE INVENTION

It is required that the conventional illuminators for use in optical instruments provide different degrees of illumination. For illuminators that provide high illumination, a fan is installed for dissipating the high heat generated in the illuminator.

Referring to FIG. 1 that is a schematic view showing a spotlight of a conventional projector. The spotlight comprises a reflector 11 formed with a semi-ellipsoidal reflecting surface and an open end 111; and a light-emitting lamp body 12 in the form of a metal halogen lamp. This kind of lamp does not explode at high temperature and there is no need of installing a lamp cover for it. Therefore, the fan 13 installed below the reflector 11 can provide a good heat dissipation effect for the light-emitting lamp body 12.

Referring to FIG. 2, a spotlight, which provides higher illumination and includes a super high pressure mercury lamp, comprises a reflector 21 formed with an inner semi-ellipsoidal reflecting surface and having an open end 211; a light-emitting lamp body 22 in the form of a super high pressure mercury lamp provided with an electrode 221 at the front thereof; and a lamp cover 23 made of a transparent material and closing the open end 211 of the reflector 21.

Due to the high pressure in the tube of super high-pressure mercury lamp, the lamp will be exploded when it is overheated. Therefore, it is necessary to install a lamp cover 23 for safety. However, with a lamp cover 23 installed, the fan 13 installed below can only dissipate the heat from the outer surface of the reflector 21 and cannot direct the cooling air into the reflector 21 to cool the light-emitting lamp body 22 directly. In other words, the heat dissipation effect on the light-emitting lamp body 22 is quite limited. Due to that the focus of the spotlight is at a small distance before the cover 23, the electrode 221, which receives the heat from the light-emitting lamp body 22 and the heat incurred by the reflected light, has to be cooled adequately. Otherwise, the light-emitting lamp body 22 is apt to burst and the electrode 221 is apt to break due to accumulated heat.

SUMMARY OF THE INVENTION

The primary object of the invention is to provide an easy-heat-dissipation spotlight structure wherein airflow can be directed onto the light-emitting lamp body to cool it directly so that the bursting of the light-emitting lamp body can be avoided.

To achieve the above object, the easy-heat-dissipation spotlight structure in accordance with the invention comprises: a reflector formed with an inner semi-ellipsoidal reflecting surface and having an open end; a light-emitting lamp body provided at the central location of the reflector; a lamp cover provided at the open end for covering the reflector, the lamp cover forming an inlet at the lower location thereof when it covers the reflector; and a baffle unit installed at the inlet of the lamp cover so that airflow can be directed into the space defined by the lamp cover and the reflector.

The airflow generated by the fan in accordance with the invention flows through the baffle unit, cools down the electrode at the fore end of the light-emitting lamp body, and flows out of the spotlight through the outlet formed at the upper portion of the reflector.

BRIEF DESCRIPTION OF THE DRAWINGS

The above and other objects and the features and effects of the present invention can be best understood by referring to the following detailed description of a preferred embodiment and the accompanying drawings, wherein.

DETAILED DESCRIPTION OF THE PREFERRED EMBODIMENT

Figure 1:
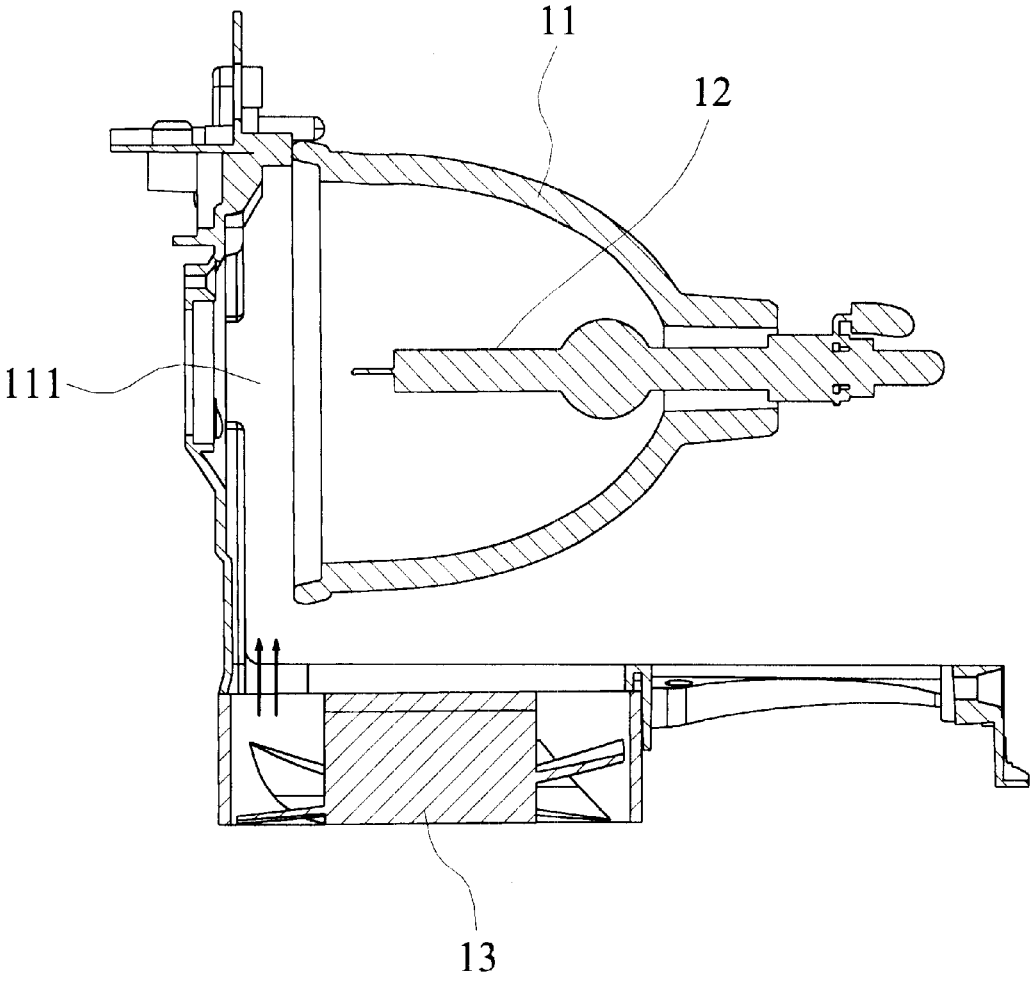
FIG. 1 (PRIOR ART)
FIG. 1 is a schematic sectional view Of the spotlight of a conventional projector.
Figure 2:
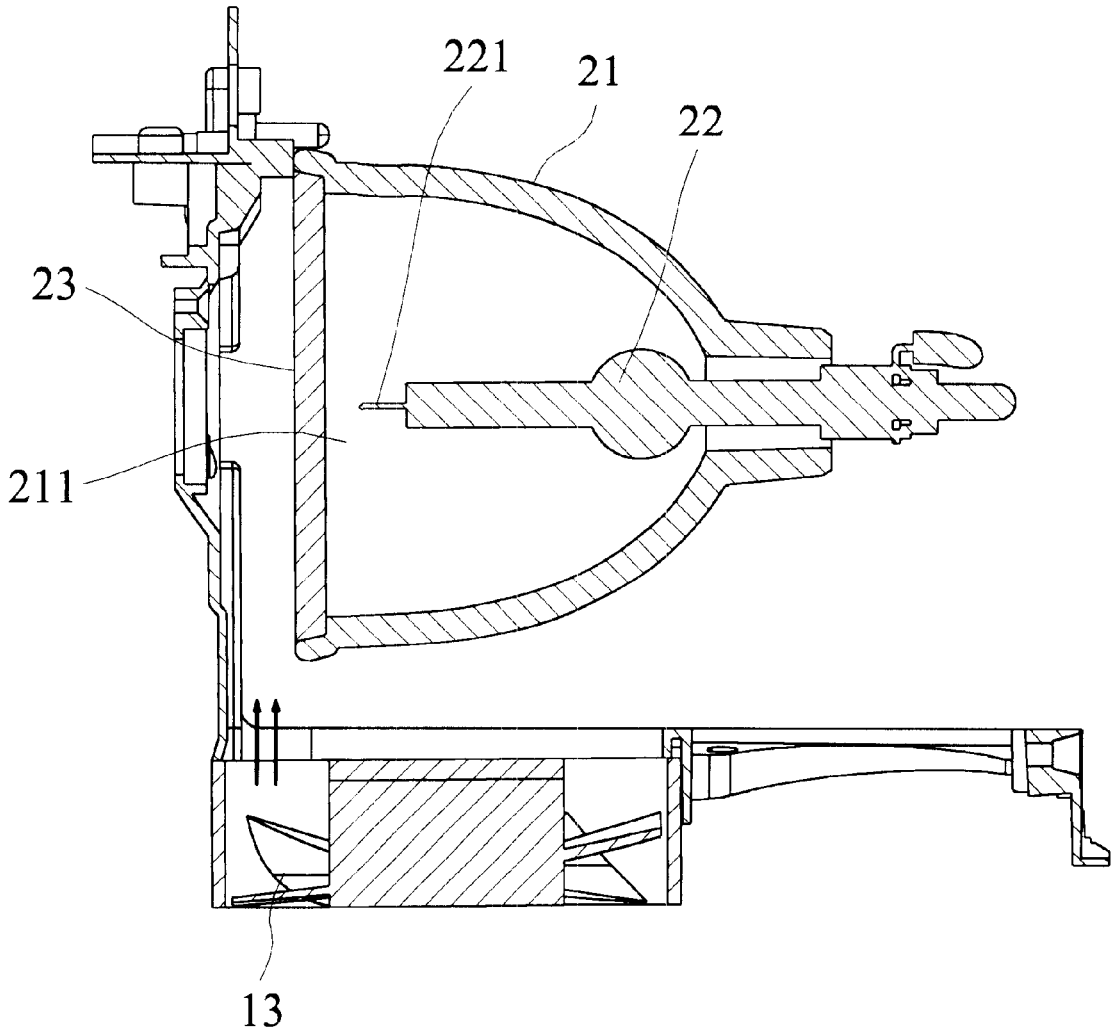
FIG. 2 (PRIOR ART)
FIG. 2 is a schematic sectional view of the spotlight comprising a conventional super high pressure mercury lamp body.
Figure 3:
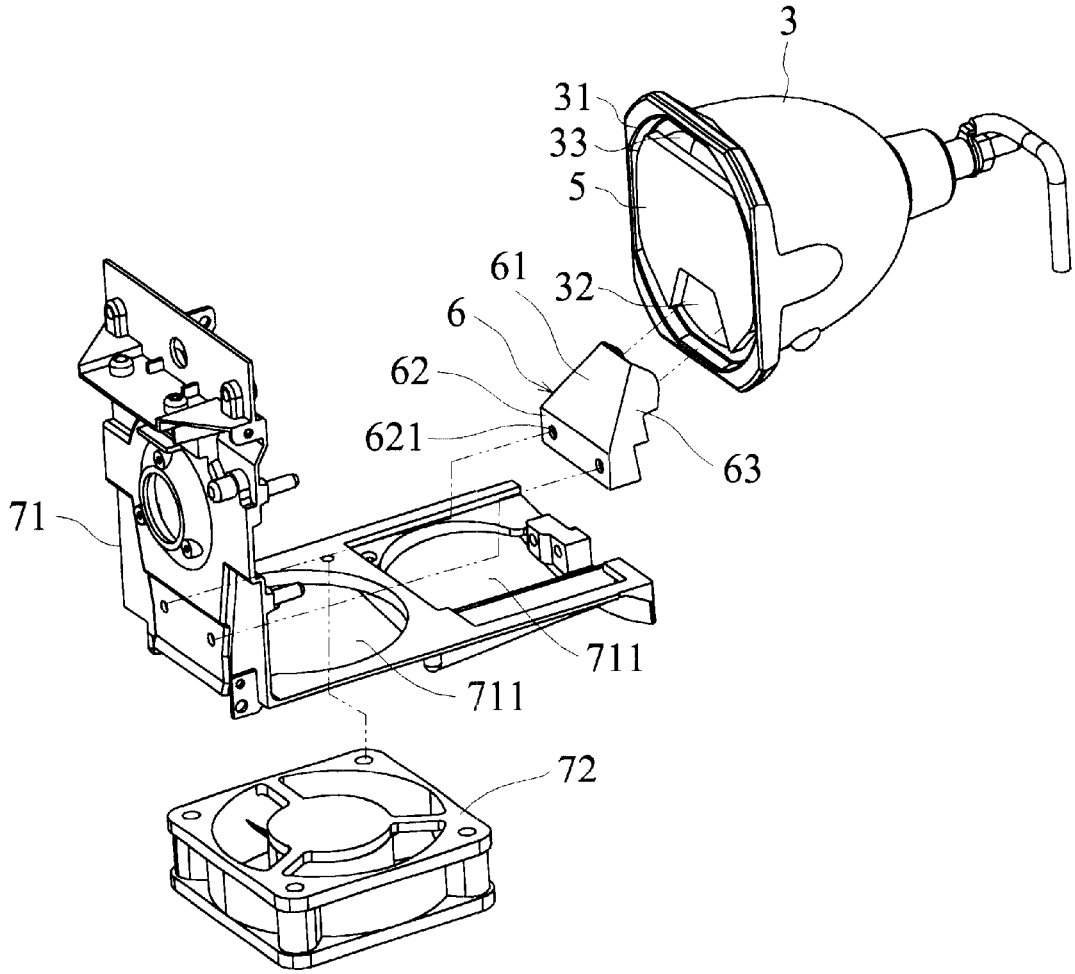
FIG. 3 is an exploded view of a spotlight structure in accordance with a preferred embodiment of the invention.
Figure 4:
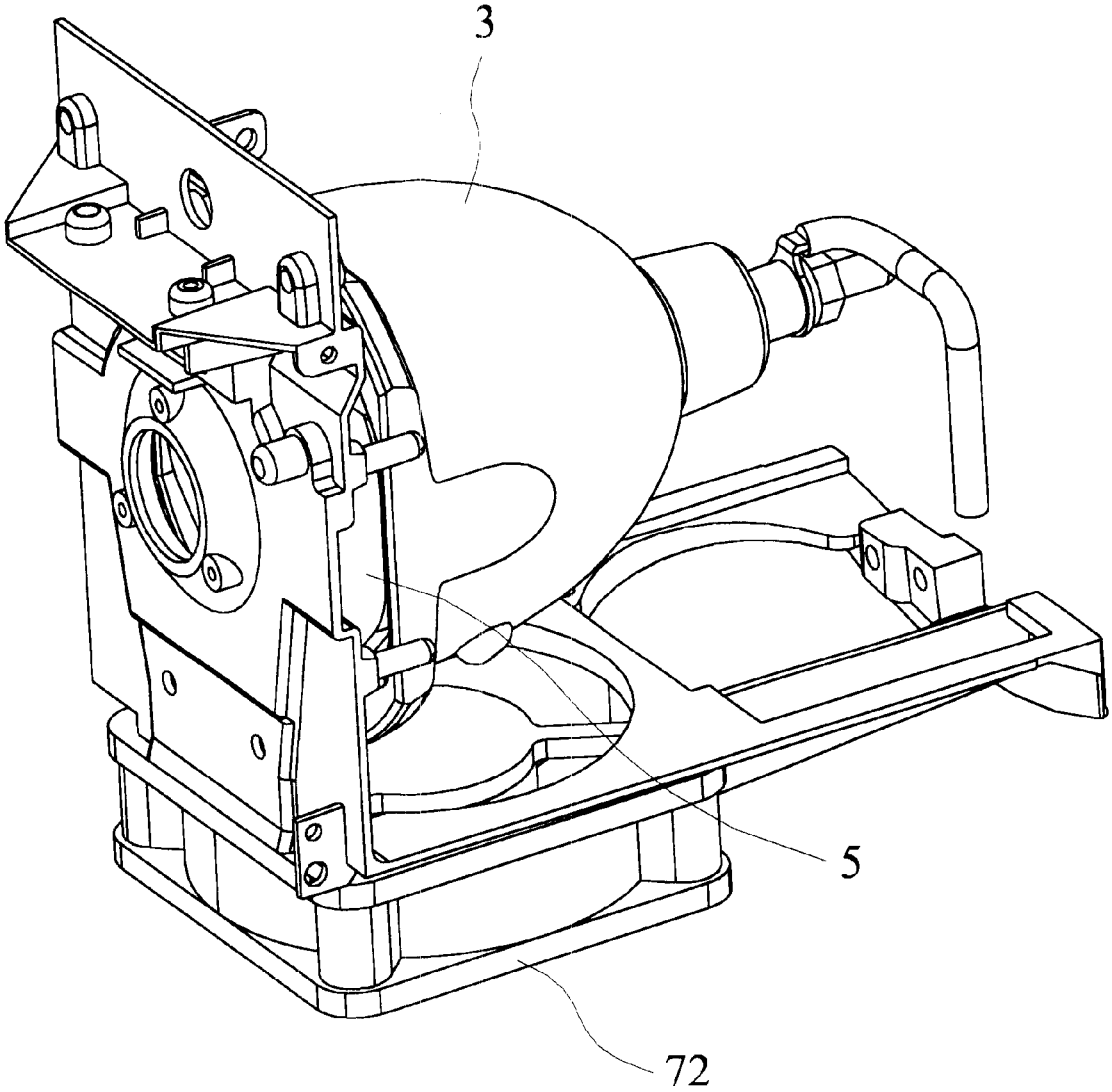
FIG. 4 is an assembly drawing of the spotlight structure in accordance with the preferred embodiment of the invention.
Figure 5:
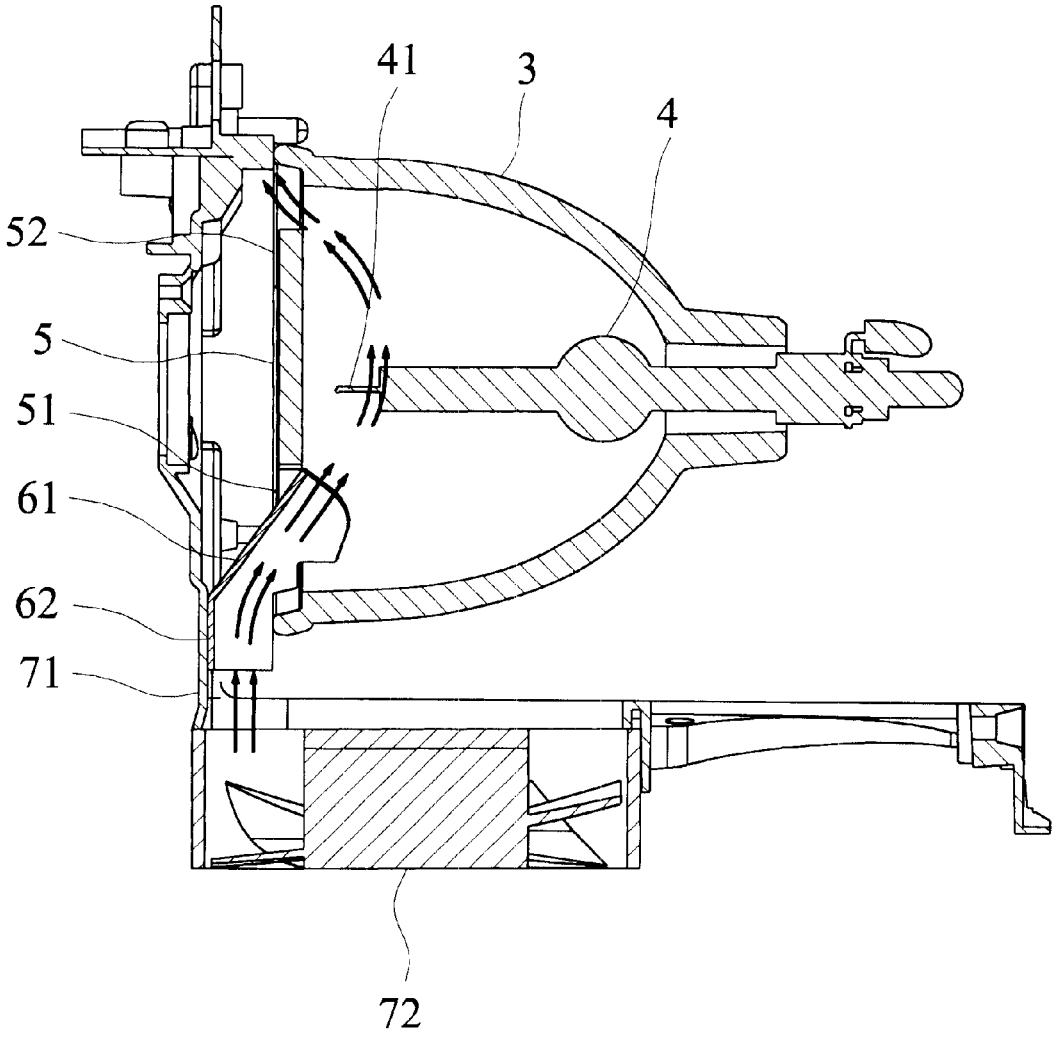
FIG. 5 is a sectional assembly drawing of the spotlight structure in accordance with the preferred embodiment of the invention.

Referring to FIGS. 3, 4, and 5, a spotlight structure in accordance with a preferred embodiment of the invention comprises a reflector 3, a light-emitting lamp body 4, a lamp cover 5, and a baffle unit 6, wherein:

The reflector 3 is formed with an inner semi-ellipsoidal reflecting surface and is open at end 31; the light-emitting lamp body 4 is provided at the central location of the reflector 3 and is a super high pressure mercury lamp provided with an electrode 41 at the fore end thereof, the lamp cover 5 is formed with a flat upper end, and a trapezoid-shaped cut 50, at its lower end and is provided at the open end 31 of the reflector 3. The lamp cover 5 and the reflector 3, when engaged together, cooperatively form a trapezoidal inlet 51 at a lower location and an outlet 52 at an upper location. An outlet 52 can alternatively be formed in the reflector 3. However, it is easier to form an outlet 52 in accordance with the preferred embodiment of the invention.

The baffle unit 6 comprises a slant sheet 61 and a vertical sheet 62. The angle between them is about 140 degrees. At each side of the slant sheet 61 and the vertical sheet 62 is provided with a side sheet 63. The slant sheet 61 is trapezoid-shaped. The slant sheet 61 generally covers the inlet 51 of the lamp cover, and forms a 40 degree angle with respect to the lamp cover 5 so that the baffle unit directs airflow into the space defined by the reflector 3 and the cover 5.

The vertical sheet 62 is formed with two threaded holes 621 for securing the vertical sheet 62 on a frame 71. A horizontal section of the frame 71 is formed with two fan installation openings 711 for installing a fan 72 in each of the openings 711. The spotlight structure in accordance with the invention is installed over the fan 72. However, the installation is not claimed and will not be described herein.

Referring to FIG. 5, when the fan 72 generates an upward airflow, the slant sheet 61 of the baffle unit 6 directs the airflow into the space defined by the reflector and the lamp cover 5 so that the airflow cools down the electrode 41 at the fore end of the light-emitting lamp body 4 directly. The airflow with the heat from the electrode 41 flows through the outlet 52. Thereby, a good cooling down effect of the light-emitting lamp body 4 can be achieved.

From the above description, it can be understood that the following advantages can be achieved by the invention:

1. The airflow from the fan 72 can be directed into the space defined by the reflector 3 and the lamp cover 5 so that the airflow directly cools down light-emitting lamp body 4 and the burst of the electrode 41 due to overheat can be avoided. Thereby, the life of the spotlight can be prolonged.

2. The spotlight structure still includes the lamp cover 5. It can avoid the danger caused by the burst of the light-emitting lamp body at a super high pressure.

Although a preferred embodiment of the invention has been illustrated and described, it will be obvious to those skilled in the art that various modifications may be made without departing from the scope and spirit of the invention defined by the appended claims.

What is claimed is:

1. An easy-heat-dissipation spotlight structure comprising:

a reflector formed with an inner semi-ellipsoidal reflecting surface and having an open end;

a light-emitting lamp body provided at the central location of the reflector;

a lamp cover provided at said open end and formed with an inlet at its lower end; and a baffle unit installed at the inlet of the lamp cover so that an airflow can be directed into the space defined by the lamp cover and the reflector and wherein the inlet of said lamp cover is trapezoid-shaped and said baffle unit comprises a slant sheet and a vertical sheet and there is a blunt angle between said slant sheet and said vertical sheet.

2. An easy-heat dissipation spotlight structure according to claim 1, where said angle is a 140-degree angle.

* * * * *

UNITED STATES PATENT AND TRADEMARK OFFICE

CERTIFICATE OF CORRECTION

PATENT NO. : 6,402,346 B1
DATED : June 11, 2002
INVENTOR(S) : Liao et al.

It is certified that error appears in the above-identified patent and that said Letters Patent is hereby corrected as shown below:

Title page,
Item [73], Assignee, please correct the information as follows:
-- CTX OPTO-ELECTRONICS CORP.
Hsinchu, Taiwan, R.O.C.
Compaq Computer Corporation
Houston, TX, (US) --

Signed and Sealed this

Fourth Day of May, 2004

JON W. DUDAS
*Acting Director of the United States Patent and Trademark Office*